US008226192B2

(12) United States Patent
Inoue et al.

(10) Patent No.: US 8,226,192 B2
(45) Date of Patent: Jul. 24, 2012

(54) PRINTING APPARATUS AND PRINTING METHOD

(75) Inventors: Koji Inoue, Tokyo (JP); Takashi Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 12/793,759

(22) Filed: Jun. 4, 2010

(65) Prior Publication Data

US 2010/0315456 A1 Dec. 16, 2010

(30) Foreign Application Priority Data

Jun. 10, 2009 (JP) ..... 2009-139534

(51) Int. Cl.
*B41J 29/38* (2006.01)

(52) U.S. Cl. ..... 347/12

(58) Field of Classification Search ..... 347/9–12, 347/40–42

See application file for complete search history.

(56) References Cited

U.S. PATENT DOCUMENTS 5,988,790 A * 11/1999 Koike et al. ..... 347/41
6,189,989 B1 2/2001 Hirabayashi et al.
6,257,701 B1 7/2001 Otani et al.
6,416,162 B1 * 7/2002 Otsuki ..... 347/41
6,601,940 B2 8/2003 Akama et al.
6,837,564 B2 1/2005 Akama et al.
7,252,356 B2 * 8/2007 Ide et al. ..... 347/12

FOREIGN PATENT DOCUMENTS

JP 5-293973 A 11/1993

* cited by examiner

*Primary Examiner* — An Do
(74) *Attorney, Agent, or Firm* — Fitzpatrick, Cella, Harper & Scinto

(57) ABSTRACT

In an ink jet printing apparatus for scanning a print medium with a printing head and printing an image thereon, the printing head includes a plurality of ink ejection port arrays. The ink ejection ports in each of the arrays are arranged in a direction crossing a scanning direction of the printing head relative to the print medium. An allowable recording rate given to at least one of the ejection port arrays behind an ejection port array located at the front in the scanning direction is set lower than that given to the one located at the front. As a result, a printing apparatus capable of suppressing a throughput speed thereof and adhesion of ink mists to a formation face of the ejection ports can be provided.

10 Claims, 9 Drawing Sheets

PRINTING APPARATUS AND PRINTING METHOD

BACKGROUND OF THE INVENTION

1. Field of the Invention

The present invention relates to an ink jet type printing apparatus and a printing method for printing an image on a print medium by moving a printing head relative to the print medium and ejecting ink from the printing head thereto.

2. Description of the Related Art

Ink jet type printing apparatuses have been known of which a printing head with a plurality of ejection nozzles provides energy to ink in the nozzles with an electro-thermal conversion element or an electro-mechanical conversion element so as to eject ink in the nozzles to a print medium so that an image is formed thereon. In the ink jet type printing apparatuses, it has been known to eject uniform color ink from a plurality of ejection nozzles in a plurality of ejection port arrays. In the ink jet type printing apparatuses, ink separated from an ink droplet which is ejected from an ejection port to a print medium is splashed to float as ink mists. The ink mists adhere on a formation face of the ejection ports of the printing head so that a large amount of the ink mists accumulate around the ejection port to possibly degrade ejection function thereof. Especially, in a printing head having a plurality of ejection port arrays arranged in a high density, airflows generated by ejected liquid droplets from ejection ports are mutually interfered between the ejection port arrays next to each other. The airflow generated by ejected liquid droplets is hereinafter referred to "self airflow". As a result, strong airflows blowing up toward the printing head are generated. Adhesion of a large amount of ink mists to around the ejection ports of the printing head is occurred by the strong airflows so that they may obstruct the ejection ports. Therefore, for example, Japanese Patent laid-open No. H05-293973 (1993) discloses a configuration wiping off ink mists adhered to a formation face of ejection ports of a printing head.

However, a process for wiping off the ink mists adhered to the formation face decreases a processing speed of the apparatus.

An object of the present invention is to provide a printing apparatus and a printing method capable of suppressing adhesion of ink mists on a formation face of ejection ports and avoiding decreasing a processing speed.

SUMMARY OF THE INVENTION

In a first aspect of the present invention, there is provided a printing apparatus for scanning a print medium with a printing head and printing an image thereon, the printing head comprising a plurality of ink ejection port arrays, each of the ink ejection port arrays having a plurality of ink ejection ports, the ink ejection ports in each of the arrays being arranged in a direction crossing a scanning direction of the printing head relative to the print medium, the plurality of ejection port arrays being arranged in the scanning direction, wherein an allowable recording rate given to at least one of the ejection port arrays behind an ejection port array located at the front in the scanning direction is lower than that given to the one located at the front.

In a second aspect of the present invention, there is provided a printing method for scanning a print medium with a printing head and printing an image thereon, the printing head comprising a plurality of ink ejection port arrays, each of the ink ejection port arrays having a plurality of ink ejection ports, the ink ejection ports in each of the arrays being arranged in a direction crossing a scanning direction of the printing head relative to the print medium, the plurality of ejection port arrays being arranged in the scanning direction, comprising a step of lowering an allowable printing rate given to at least one of the ejection port arrays located behind an ejection port array at the front in the scanning direction than that given to the one located at the front.

Further features of the present invention will become apparent from the following description of exemplary embodiments (with reference to the attached drawings).

DESCRIPTION OF THE EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. The term "print" as used herein refers not only to formation of significant information such as characters or graphics but also to formation of images, patterns, or the like on a printed material or processing of a print medium, in a broad sense, regardless of whether or not the image is significant and whether or not the image is actualized so as to be visually perceived by human beings. The term "print medium" refers not only to paper used for common ink jet printing apparatuses but also to fabrics, plastic films, metal plates, or the like, that is, anything that can receive ink ejected by a head, in a broad sense. The term "ink" should be broadly interpreted as in the case of the definition of the term "print" and refers to a liquid applied onto a printed material and used to form images, patterns, or the like or to process a printed material. The term "nozzle" refers to a ink ejection port and a fluid pathway communicated therewith unless otherwise defined.

Figure 1:
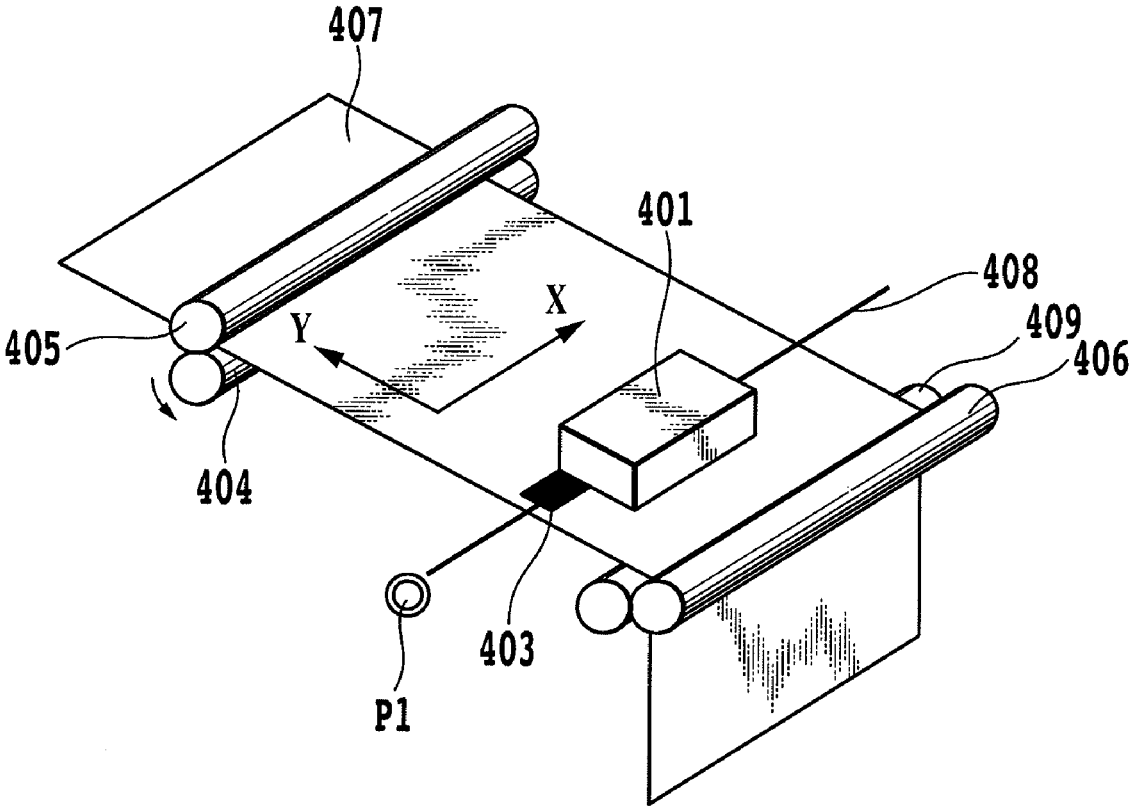
FIG. 1 is a perspective view showing an example of a printing unit in a printing apparatus, to which the present invention is applied.

As shown in FIG. 1, a printing apparatus according to the present invention has a printing head 401 mounted on a carriage 403 which is movable in X-direction along a guide shaft 408. The printing head 401 has an ink tank for supplying to 4-color ink consisting of black Bk, cyan Cy, magenta Mg and yellow Y. The printing head 401 has 4-color printing element arrays corresponding to the ink tanks, respectively, which are integrated with each other.

The carriage 403 is located at a home position in FIG. 1 when in standby states such as a non-printing state. A sheet feeding roller 404 pinches a print medium 407 together with a pinching roller 405 and rotates in an arrow direction in FIG. 1 so that the print medium is conveyed in Y-direction. A sheet feeding roller 406 feeds a print medium 407 from a tray (not shown) in which print mediums are stacked. The sheet feeding roller 406 also pinches a print medium 407 together with a pinching roller 409.

Figure 2:
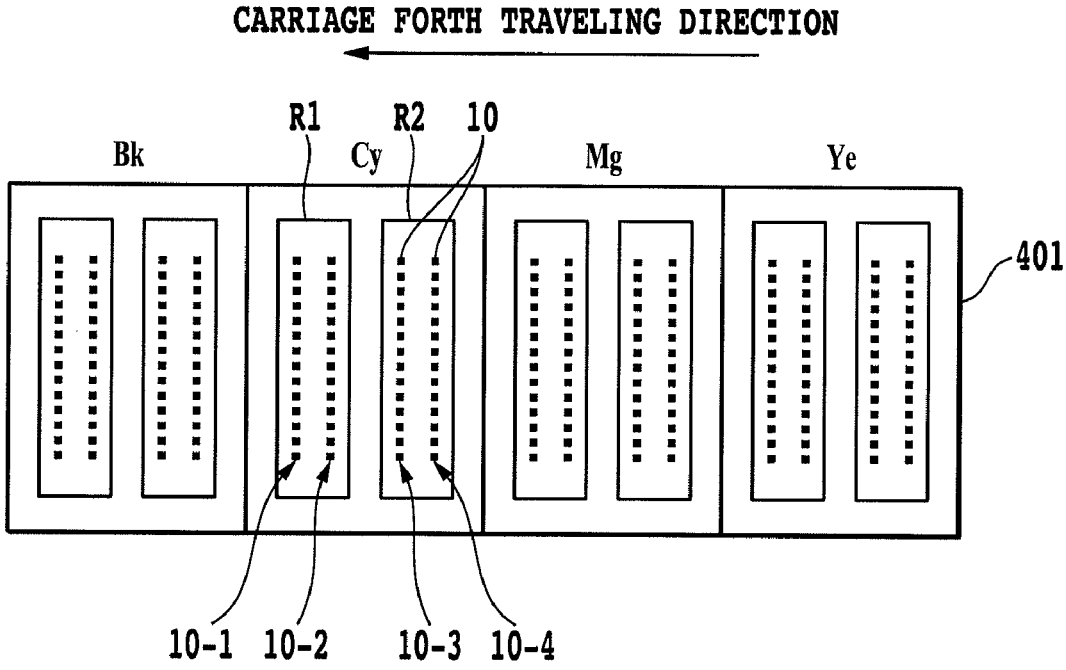
FIG. 2 is a view of a printing head of FIG. 1 from a side of ejection port formation face.

A platen (not shown) is arranged at a position facing to the printing head 401, which supports a print medium so as to face to the printing head 401. A mechanism for moving up and down the platen is provided so that a distance between an ejection port surface of the head and the platen is adjusted. As shown in FIG. 2, the printing head 401 has a plurality of ejection port arrays 10-1 to 10-4 arranged in a traveling direction of the carriage for each ink of BK, CY, Mg and Ye. The ejection port arrays 10-1 to 10-4 for each color include a plurality of ejection ports 10 linearly arranged for ejecting ink. Four ejection port arrays are formed for each color. A first ejection port array pair R1 includes the ejection port arrays 10-1 and 10-2 for each color. A second ejection port array pair R2 includes the ejection port arrays 10-3 and 10-4 for each color. The ejection ports included in each of the ejection port arrays 10-1 to 10-4 are arranged in a direction crossing scanning directions of the printing head 401 (back and forth directions of the carriage). The ejection port arrays 10-1 to 10-4 are aligned in the scanning directions of the printing head 401.

Figure 3:
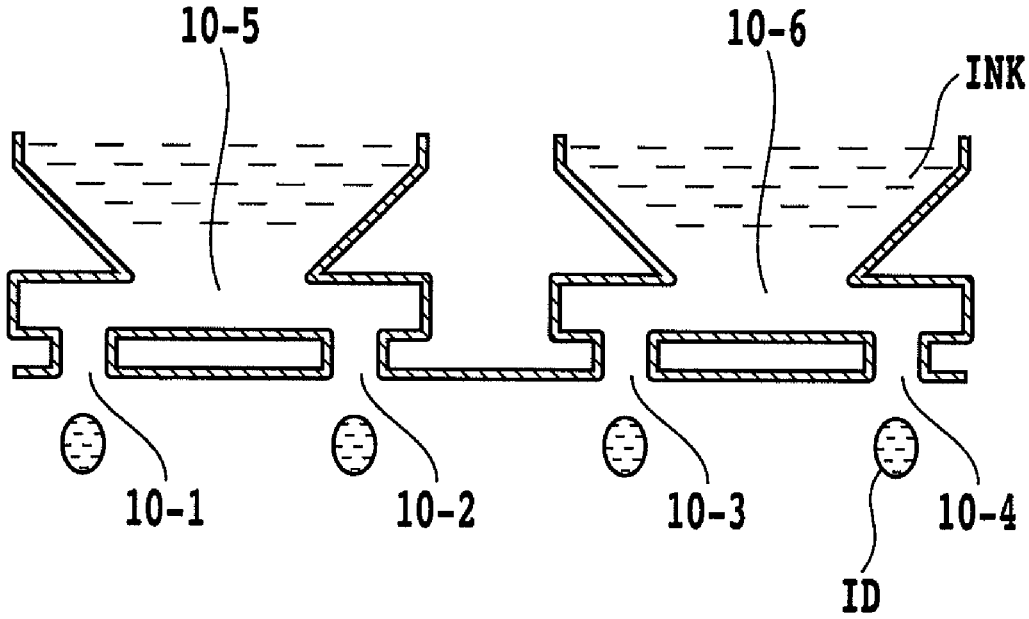
FIG. 3 is a sectional view of the printing head of FIG. 1 in a direction of an ejection port array.

As shown in FIG. 3, the ejection port arrays 10-1 and 10-2 for each color are communicated with a common chamber 10-5. The ejection port arrays 10-3 and 10-4 for each color are communicated with a common chamber 10-6. The ejection port arrays 10-3 is arranged apart from the ejection port arrays 10-4 with a distance 1.6 mm. The ejection port array 10-1 is apart from ejection port array 10-2 with a distance of 0.3 mm. The ejection port array 10-3 is apart from the ejection port array 10-4 with a distance of 0.3 mm. A width of the printing element for each color is 3.2 mm.

Next, an operation of the above mentioned printing apparatus will be described below. The carriage 403 located at the home position P1 when in a standby state starts to scan in X-direction in respond to a printing start command and selectively drive the plurality of nozzles of the printing head 401 in accordance with printing data so that ink is ejected to the print medium 407 and an image is printed thereto. When a printing from one end portion to the other of the print medium 407 is completed by a single scanning, the carriage 403 is returned to the original home position P1. Here, the print medium is conveyed a predetermined length in Y-direction by a rotation of the sheet feeding roller 404 in the arrow direction, and then scanning and printing in X-direction are re-started. By alternating scanning and conveying of the print medium, an image is printed on the print medium. A distance between the printing head and a print medium is variable in accordance with a type of a print medium to be printed and a printing mode.

Figure 4:
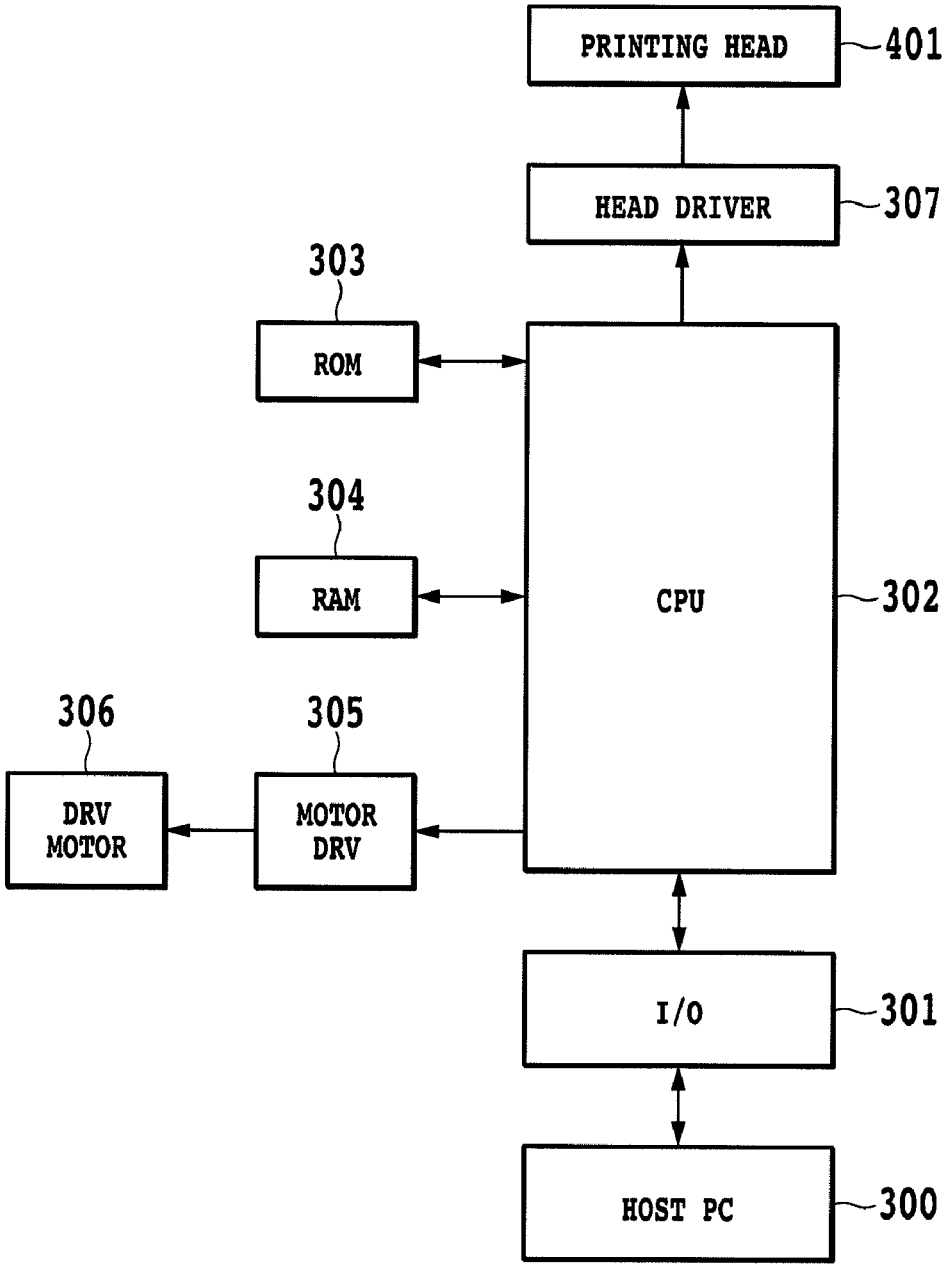
FIG. 4 is a block diagram showing a controlling system of the printing apparatus of FIG. 1.

Next, a configuration of a controlling system of the above ink jet type printing head will be described with reference to FIG. 4. In FIG. 4, a host computer 300 sends control data such as a printing command and image data to be printed to a printing apparatus, and receives status information and the like from the printing apparatus. An I/O interface 301 receives control data and image data from the host computer 300 and sends status information and the like to the host computer 300. A CPU 302 controls the entire apparatus. ROM 303 stores data such as control program and font. RAM 304 functions as recording buffer for temporarily storing printing data and a work area for the CPU. A motor driver 305 drives a variety of driving motors for driving the carriage 403, a conveying roller, a sheet feeding roller and the like. A head driver 307 drives the printing head 401.

Image data sent from the host computer 300 is temporarily stored in a receive buffer, converted to processable print data in the printing apparatus and then supplied to the CPU. The CPU 302 apportions the print data supplied thereto to an ink unit and temporarily stores them in a recording buffer of the RAM 304. The print data stored in the recording buffer of the RAM 304 is re-retrieved in driven order of the printing elements for each ink by the CPU 302. The print data is apportioned to each of printing element arrays with mask patterns stored in the ROM 304 and output to the head driver 307 in response to actual ejection timing. As a result, a printing head corresponding printing data is driven so that ink is ejected and printing is done.

Next, a driving method for a printing head according to first embodiment of the present invention using the above printing apparatus will be explained with reference to FIG. 5. In the present embodiment, in case where a positional relationship between the print medium 407 and the printing head 401 is not satisfied with a predetermined relationship, allowable printing rates given to the plurality of the ejection port arrays 10-1 to 10-4, respectively, are equalized to each other. Here, the allowable printing rate is defined as a rate of pixels being allowable to be printed with respect to all pixels in a unit area. In a general method for altering the allowable printing rate, a mask pattern defining whether to allow an ejection of an ink droplet to each pixel is applied to binary printing data defining whether to eject an ink droplet to each pixel. As a result, the printing data is thinned out. In particular, in case in which an ejection of ink to each of all pixels of an image is allowable and the image is formed by so-called one pass printing which completes the image with a single scanning, a distance between the head and platen is adjusted in respond to a type of a print medium to be printed or a printing mode. In this case, the allowable printing rate to each of the ejection port arrays 10-1 to 10-4 is equalized to each other. That is, ejection data is apportioned to each of the ejection port arrays so that an allowable printing rate given to one ejection port array is 25% and a total of the allowable printing rates given to the four ejection port arrays are 100%. On the other hand, in case in which the relationship is satisfied with a predetermined relationship, each of the allowable printing rates given to the ejection port arrays 10-1 to 10-4 is altered as described below.

Here, for example, when a distance between the printing head 401 and the print medium 407 (hereinafter referred to "sheet-to-head distance") is longer than a distance between the ejection port arrays 10-2 and 10-3 (hereinafter referred to "array-to-array distance"), the relationship is satisfied with the predetermined relationship. A vortical airflow, that is a self generated airflow, is formed around an ink droplet ejected from an ejection port 10. In addition to this, a relative movement between the printing head 401 and the print medium 407 generates a shearing airflow (an influent airflow). If distances next to each other in the ejection port arrays 10-1 to 10-4 are relatively short, each of the self-airflows generated by ink droplets is mutually interfered with the shearing airflow to each other. As a result, airflows blowing up toward a formation face of the ejection ports 10 are generated so that ink mists carried by the airflows tend to adhere to the formation face. The longer the distance between the print medium 401 and the printing head 407, the more significant the interference influence between each of the self-airflows and the shearing airflow. Accordingly, if a sheet-to-head distance is longer than an array-to-array distance, it can be judged that the interference influence between each of the self-airflows and the shearing airflow becomes significant, so that allowable printing rates given to the ejection port arrays 10-1 to 10-4 are altered as described below.

Figure 5A:
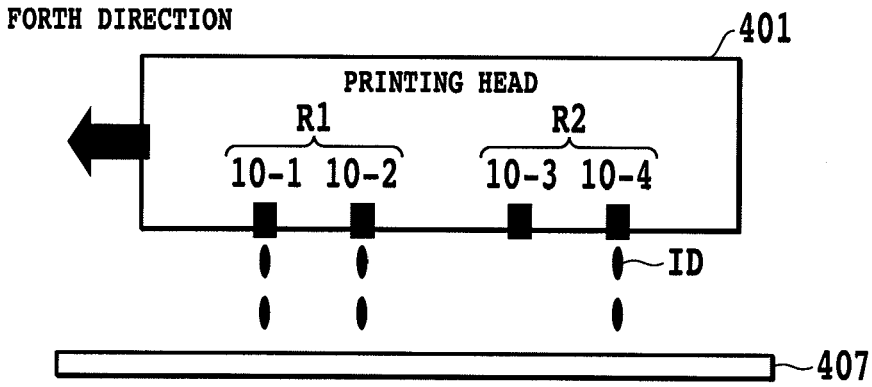
FIG. 5A is an explanatory view of an operaten of the printing head in a forth direction according to an embodiment of the invention.

As shown in FIG. 5A, when the printing head 401 is traveling in a forth direction, a scanning direction of the printing head 401 is a forth direction. In this situation, ink droplets ID are ejected from the ejection ports 10 of both of the ejection port arrays 10-1 and 10-2 in the ejection port array pair R1 located before the ejection port array pair R2 in the scanning direction of the printing head 401. In addition, ink droplets ID are ejected from the ejection ports 10 of either the ejection port array 10-3 or 10-4 in the ejection port array pair R2 located behind the ejection port array pair R1. Each of the allowable printing rates given to the three ejection port arrays is equal to each other. As a result, the allowable printing rate given to the ejection ports 10 in the ejection port array pair R2 is set lower than that given to the ejection ports 10 in the ejection port array pair R1.

Figure 5B:
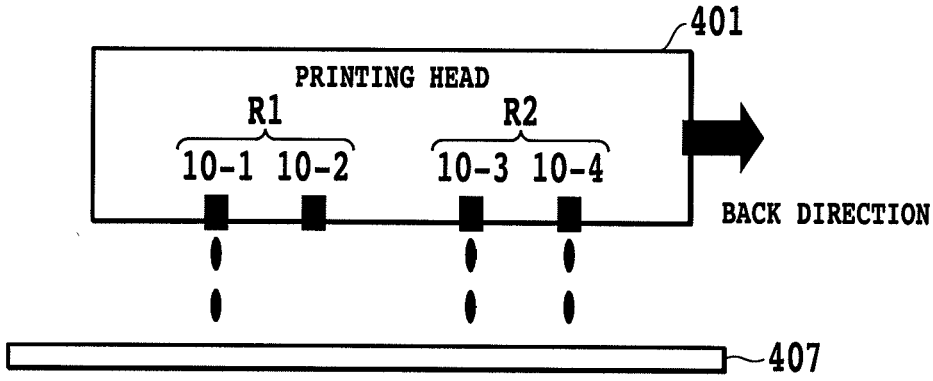
FIG. 5B is an explanatory view of an operaten of the printing head in a back direction.

As shown in FIG. 5B, when the printing head 401 is traveling in a back direction, the scanning direction of the printing head 401 is a back direction. In this situation, ink droplets ID are ejected from the ejection ports 10 of both of the ejection port arrays 10-3 and 10-4 in the ejection port array pair R2 located before the ejection port array pair R1 in the scanning direction of the printing head 401. In addition, ink droplets ID are ejected from the ejection ports 10 of either the ejection port array 10-1 or 10-2 in the ejection port array pair R1 located behind the ejection port array pair R2. Each of the allowable printing rates given to the three ejection port arrays is equal to each other. As a result, the allowable printing rate given to the ejection ports 10 in the ejection port array pair R1 is set lower than that given to the ejection ports 10 in the ejection port array pair R2.

Preferably, the allowable printing rate given to the ejection ports 10 of the ejection port array on the front side of the ejection port array pair located downstream in the scanning direction of the printing head 401 is set to 0% so as to prevent them from ejecting ink droplets ID. That is, in case of FIG. 5A, the ejection port array on the front side is the ejection port array 10-3. In case of FIG. 5B, the ejection port array on the front side is the ejection port array 10-2. This is because an occurrence of upward airflows blowing up toward the printing head 401 generated by interferences between each of the self airflows can be suppressed more effectively by separating the ejection port array located downstream which actually ejects ink droplets as far away from the two ejection port arrays located upstream as possible. Note that even though not using the ejection port array 10-4 instead of the array 10-3 in the froth direction scanning and the ejection port array 10-1 instead of the array 10-2 in the back direction scanning for ejecting ink droplets, the effectiveness of the present invention also can be obtained.

Next, second embodiment according to the present invention will be explained with reference to FIG. 6. In the present embodiment, as the first embodiment, in case where the sheet-to-head distance is shorter than the array-to-array distance, an allowable printing rate given to each of the ejection port arrays 10-1 to 10-4 is mutually equal to each other. That is, the allowable printing rate given to each of the ejection port arrays is 25% and a total of the allowable printing rates given to the ejection port arrays are 100%. On the other hand, in case where the sheet-to-head distance is longer than the array-to-array distance, each of the allowable printing rates given to the ejection port arrays 10-1 to 10-4 is altered as described below.

Figure 6A:
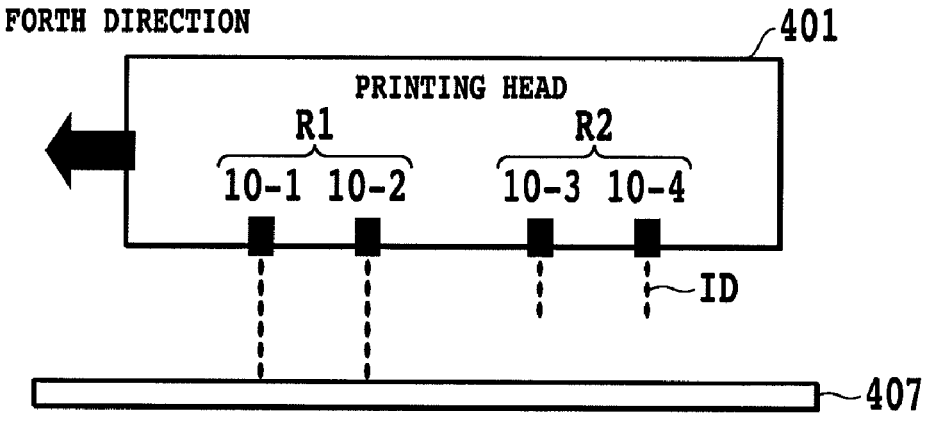
FIG. 6A is an explanatory view of an operaten of a printing head in a forth direction according to another embodiment of the invention.

As shown in FIG. 6A, when the printing head 401 is traveling in a forth direction, an allowable printing rate given to the ejection port array pair R2 located downstream is set lower than that given to the ejection port array pair R1 located upstream. For example, when forming an image with an allowable printing rate of 100% in total, in the forth direction scanning, the ejection port arrays 10-1 and 10-2 are given an allowable printing rate of 70% in total and the ejection port arrays 10-3 and 10-4 are given an allowable printing rate of 30% in total.

Figure 6B:
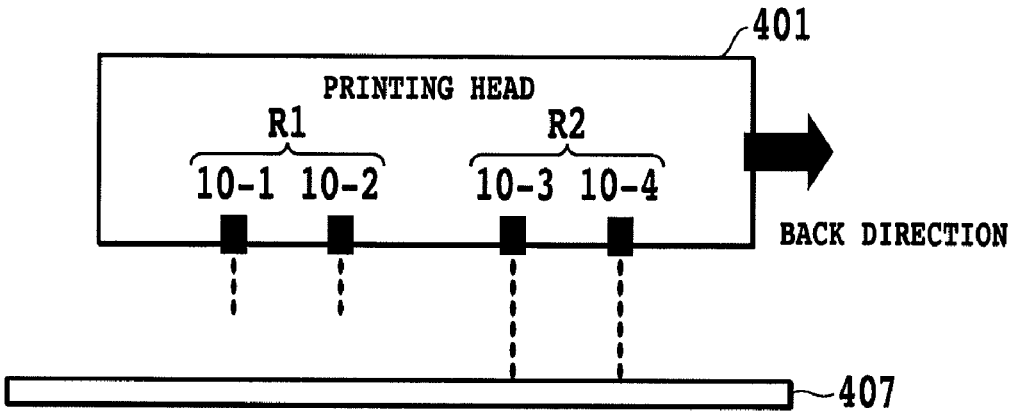
FIG. 6B is an explanatory view of an operaten of the printing head in FIG. 6A in a back direction.

As shown in FIG. 6B, when the scanning direction of the printing head 401 is reversed to the back direction, the positional relationship between the ejection port arrays 10-1, 10-2 and the ejection port arrays 10-3, 10-4 is also reversed so that the ejection port arrays 10-3 and 10-4 are given an allowable printing rate of 70% in total and the ejection port arrays 10-1 and 10-2 are given an allowable printing rate of 30% in total. It is necessary that the allowable printing rate given to the two ejection port arrays located downstream in total is lower than that given to the ejection port arrays located upstream in total in the scanning direction. However, each of ratios between the allowable printing rates given to the ejection port arrays located upstream and downstream in the forth direction scanning and the back direction can be different from each other.

Next, third embodiment according to the present invention will be explained with reference to FIGS. 7 to 9.

Figure 7:
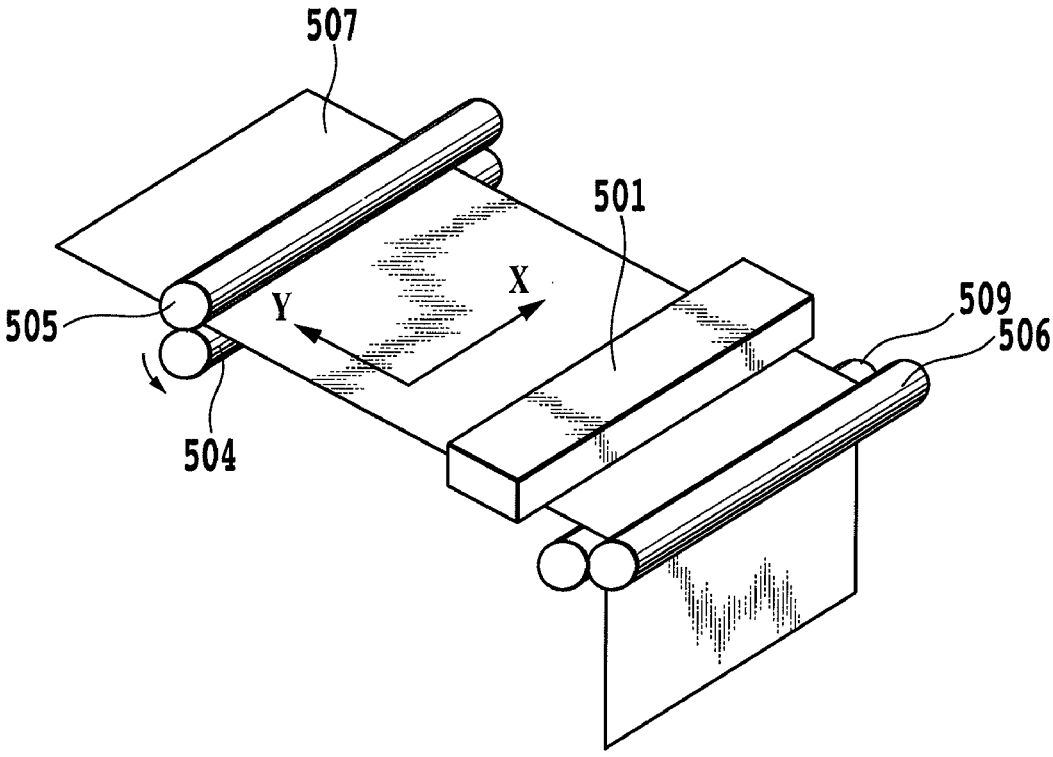
FIG. 7 is a perspective view schematically showing an another example of an unit in a printing apparatus, to which the present invention is applied.
Figure 8:
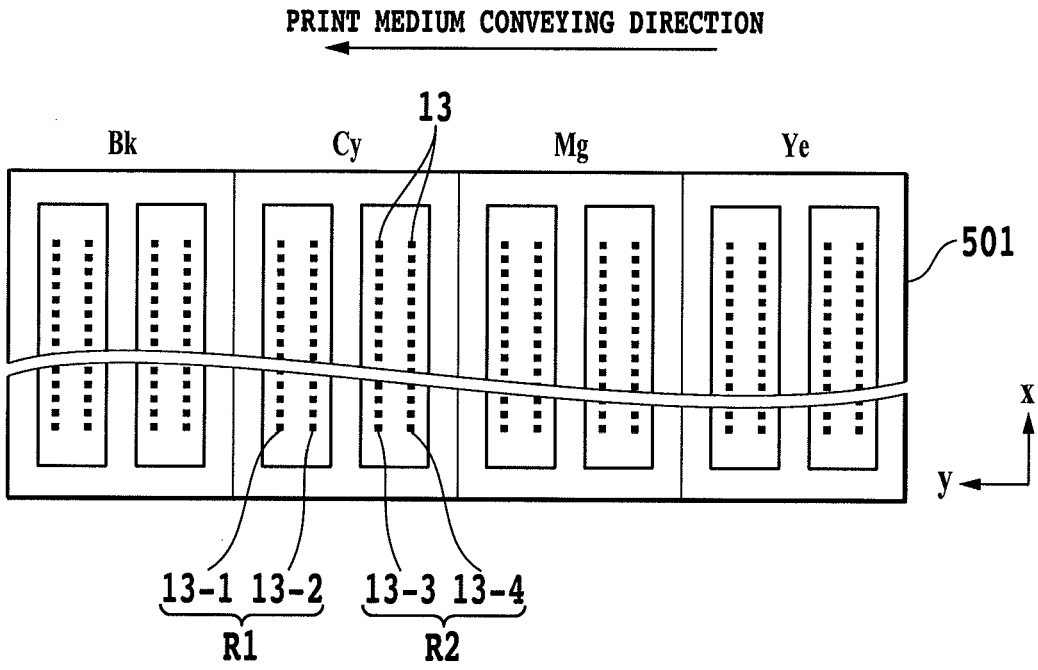
FIG. 8 is a view of the printing head in the printing apparatus in FIG. 7 from an ejection port formation face side.

In FIG. 7, a printing head 501 is stationary and a print medium 507 is conveyed. Thus, a relative movement between the print medium and the printing head 501 is generated. As shown in FIG. 8, the printing head 501 has ejection port arrays 13-1 to 13-4 arranged in order of Bk, Cy, Mg and Ye from a head in a conveying direction of the print medium (Y-direction). An ejection port array pair R2 includes the ejection port arrays 13-1 and 13-2. An ejection port array pair R1 includes the ejection port arrays 13-3 and 13-4. In this case, a scanning direction of the printing head 507 is an opposite direction to the conveying direction of the printing medium 507.

In the present embodiment, as the first and second embodiments, in case where the sheet-to-head distance is shorter than the array-to-array distance, an allowable printing rate given to each of the ejection port arrays 13-1 to 13-4 is mutually equal to each other. That is, the allowable printing rate given to each of the ejection port arrays is 25% and a total of the allowable printing rates given to the ejection port arrays are 100%. On the other hand, in case where the sheet-to-head distance is longer than the array-to-array distance, each of the allowable printing rates given to the ejection port arrays 13-1 to 13-4 is altered as shown in FIG. 9.

Figure 9:
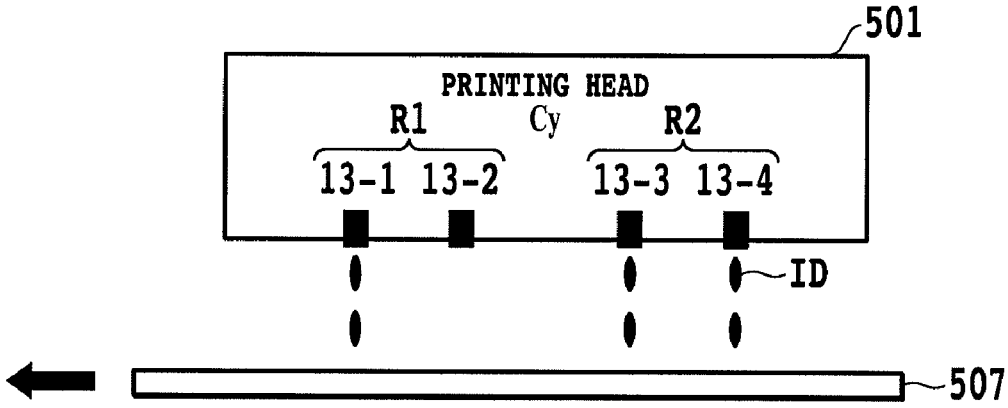
FIG. 9 is an explanatory view of an operation of a printing head of still another embodiment according to the present invention.

As shown in FIG. 9, ink droplets are ejected from the ejection ports of either the ejection port arrays 13-1 or 13-2 in the ejection port array pair R1 located upstream in the conveying direction of the printing head 507. In addition, ink droplets is ejected from the ejection ports of both of the ejection port arrays 13-3 and 13-4 in the ejection port array pair R2 located downstream in the conveying direction of the printing head 507. The three ejection port arrays used for forming an image are given equal allowable printing rates, respectively. A total of the allowable printing rates given to the three ejection port arrays are 100%. As the first embodiment, it is preferable to give an allowable printing rate of 0% to the ejection port array 13-2 to prevent it from ejecting ink droplets.

In the above third embodiment, an image is completed by conveying a sheet in one conveying direction so as to scan the sheet once. In case where an image is completed by reversing the conveying direction of the sheet so as to scan the sheet more than once, relationship between upstream and downstream in the conveying direction of the sheet is also altered when the conveying direction of the sheet is reversed.

Alternatively, as the second embodiment, an allowable printing rate given to the ejection port arrays pair R1 can be set lower than that given to the ejection port arrays pair R2.

In the above embodiments, a total number of the ejection port arrays are four, however, the present invention is not limited to this configuration. The present invention is applicable in both cases of fewer than four and more than four.

In the above embodiments, an allowable printing rate given to an ejection port array pair located downstream is set lower than that given to the pair located upstream. However, an allowable printing rate given to the ejection port array on the rear side of the ejection port array pair located upstream can be set lower than that given to the one on the front side thereof. That is, it is necessary that an allowable printing rate given to ejection ports of at least one ejection port array behind the ejection port array located at the front in the scanning direction is lower than that given to the one located at the front.

In the above description, it was explained that a variety of influences of airflows can be generated based on a relationship between the sheet-to-head distance and the array-to-array distance and it is preferable to apportion an allowable printing rate to each of ejection port arrays in response to the relationship between the sheet-to-head distance and the array-to-array distance. However, it is necessary to obtain information of not only a distance between the head and the platen but also a type (a thickness) of a print medium. Accordingly, processes for obtaining the information become cumbersome. Therefore, it can be possible to neglect the thickness of the print medium and apportion an allowable printing rate in response to only the distance the head and the platen to each of ejection port arrays.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-139534, filed Jun. 10, 2009, which is hereby incorporated by reference herein in its entirety.

What is claimed is:

1. A printing apparatus for printing an image on a print medium by ejecting ink, comprising:

a printing head configured to relatively scan a print medium while ejecting ink, the printing head comprises:

first and second ink ejection port array pairs, each comprising at least two ink ejection port arrays arranged at a predetermined distance to each other, respectively, wherein each of the ink ejection port arrays have a a plurality of ink ejection ports, arranged in a direction crossing a scanning direction of the printing head relative to the print medium, and the plurality of ejection port arrays are arranged in the scanning direction, and wherein an allowable recording rate given to the first ink ejection port array pair, located on a downstream side in the scanning direction, is lower than an allowable recording rate given to the second ink ejection port array pair, located on an upstream side in the scanning direction.

2. The printing apparatus according to claim 1, wherein the plurality of ink ejection ports in both of the at least two ink ejection port arrays of the second ink ejection port array pair eject ink, and the plurality of ink ejection ports in either of the at least two ink ejection port arrays in the first ink ejection port array pair eject ink.

3. The printing apparatus according to claim 2, wherein only the plurality of ink ejection ports in a first ink ejection port array located before a second ink ejection port array, in the scanning direction, in the first ink ejection port array pair eject ink.

4. The printing apparatus according to claim 1, wherein each of the allowable printing rates given to the first and second ink ejection port array pairs is different from each other when a positional relationship between the print medium and the printing head meets a predetermined condition, and each of the allowable printing rates given to the first and second ejection port array pairs is equal to each other when the positional relationship does not meet the predetermined condition.

5. The printing apparatus according to claim 1, wherein the first and second ink ejection port array pairs eject ink of the same color.

6. A printing method for printing an image on a print medium by scanning a printing head while ejecting ink, comprising:

a scanning step of relatively scanning a print medium with a printing head while ejecting ink, the printing head comprising:

first and second ink ejection port array pairs, each comprising at least two ink ejection port arrays arranged at a predetermined distance to each other, respectively, wherein each of the ink ejection port arrays have a plurality of ink ejection ports, arranged in a direction crossing a scanning direction of the printing head relative to the print medium, and the plurality of ejection port arrays are arranged in the scanning direction, and wherein the printing head ejects ink in the scanning step under a condition that an allowable recording rate given to the first ink ejection port array pair, located on a downstream side in the scanning direction, is lower than an allowable recording rate given to the second ink ejection port array pair, located on an upstream side in the scanning direction.

7. The printing method according to claim 6, wherein the plurality of ink ejection ports in both of the at least two ink ejection port arrays of the second ink ejection port array pair eject ink, and the plurality of ink ejection ports in either of the at least two ink ejection port arrays in the first ink ejection port array pair eject ink.

8. The printing method according to claim 7, wherein only the plurality of ink ejection ports in a first ink ejection port array located before a second ink ejection port array, in the scanning direction, in the first ink ejection port array pair eject ink.

9. The printing method according to claim 6, wherein each of the allowable printing rates given to the first and second ink ejection port array pairs is different from each other when a positional relationship between the print medium and the printing head meets a predetermined condition, and each of the allowable printing rates given to the first and second ejection port array pairs is equal to each other when the positional relationship does not meet the predetermined condition.

10. The printing method according to claim 6, wherein the first and second ink ejection port array pairs eject ink of the same color.

* * * * *